US010077566B2

(12) United States Patent
Marshall

(10) Patent No.: US 10,077,566 B2
(45) Date of Patent: Sep. 18, 2018

(54) SAFETY RAILING MOUNT FOR ROOF

(71) Applicant: Richard Marshall, Morinville (CA)

(72) Inventor: Richard Marshall, Morinville (CA)

( * ) Notice: Subject to any disclaimer, the term of this patent is extended or adjusted under 35 U.S.C. 154(b) by 358 days.

(21) Appl. No.: 14/826,786

(22) Filed: Aug. 14, 2015

(65) Prior Publication Data

US 2017/0044783 A1 Feb. 16, 2017

(51) Int. Cl.

| | |
|---|---|
| ***E04G 3/22*** | (2006.01) |
| ***E04G 3/26*** | (2006.01) |
| ***E04G 21/32*** | (2006.01) |

(52) U.S. Cl.

CPC ..... *E04G 21/3219* (2013.01); *E04G 21/3214* (2013.01); *E04G 21/3223* (2013.01)

(58) Field of Classification Search

CPC .. E04G 3/22; E04G 3/26; E04G 5/041; E04G 21/3214; E04G 21/3223; E04G 21/3233

See application file for complete search history.

(56) References Cited

U.S. PATENT DOCUMENTS

| | | | | |
|---|---|---|---|---|
| 2,729,411 A * | 1/1956 | Cahill | ..... | D06F 57/00 248/224.8 |
| 5,896,719 A * | 4/1999 | Thornton | ..... | E04G 21/3261 182/45 |
| 7,377,491 B2 * | 5/2008 | Fuoco | ..... | E04F 11/1812 256/65.01 |
| 8,448,923 B1 * | 5/2013 | Schad | ..... | E04G 21/3242 256/59 |

FOREIGN PATENT DOCUMENTS

| | | | | |
|---|---|---|---|---|
| CA | 2506676 A1 * | 6/2004 | ..... | B65D 19/06 |
| CA | 2495683 A1 * | 8/2006 | ..... | E04G 21/3214 |
| DE | 10034066 A1 * | 1/2002 | ..... | E04G 21/3214 |

* cited by examiner

*Primary Examiner* — Michael P Ferguson

(74) *Attorney, Agent, or Firm* — Adrian D. Battison; Ade & Company Inc; Kyle R. Satterthwaite

(57) ABSTRACT

Apparatus for mounting safety railing to a roof comprising a face plate extending along the length of the roof. A mounting plate arranged to be mounted to the face plate of the roof. A receiving hole on the mounting plate arranged to receive a vertical support post thereby supporting the post in a vertical position preventing horizontal movement of the post. A safety rail arrangement supported by the vertical post. A first end of the post is arranged to be supported in a vertical manner to a suitable support below the mounting plate.

3 Claims, 5 Drawing Sheets

SAFETY RAILING MOUNT FOR ROOF

BACKGROUND OF THE INVENTION

In times past when concern about safety was less developed, workers on roofs simply accepted the risk of falling and carried out their tasks without safety harnesses or safety rails.

In more enlightened times, requirements have been set forth that all workers at risk of falling must be protected. In many cases this is done by harnesses and fall restraint cables but often this is restrictive, particularly where there are a number of workers in the area to be protected.

An alternative approach is to provide a safety fence around the perimeter of the area. A number of proposals have been made to provide such a construction. Typically this is done by constructing a full scaffolding around the perimeter but this is expensive and time consuming. Alternative constructions have been provided but often these do not provide sufficient stability.

SUMMARY OF THE INVENTION

It is one object of the invention to provide an apparatus for mounting safety railing to a roof.

According to the invention there is provided an apparatus for mounting safety railing to a roof where the roof has a vertical face plate extending along the length of the roof and an inclined roof deck, the apparatus comprising a mounting plate having an edge flange portion arranged to be mounted by screw fasteners at the face plate of the roof;

a receiving hole on the mounting plate arranged to receive a vertical support post thereby supporting the post in a vertical position preventing horizontal movement of the post;

a safety rail arrangement supported by a portion of the vertical post above the mounting plate;

and a support below the mounting plate for engaging and supporting a lower end of the post in a vertical orientation so as to extend from the ground through the hole in the mounting plate to the safety rail arrangement.

In one arrangement the edge flange portion of the mounting plate is coplanar with the mounting plate and is fastened to a horizontal top edge of the face plate.

In another arrangement the mounting plate has an upturned edge flange portion which is fastened to a front face of the face plate where preferably the mounting plate has a plate portion arranged to extend horizontally outwardly from an outer surface of the face plate.

Preferably the lower end the post is supported at the ground surface.

Preferably the receiving hole has a downturned flange portion around the hole.

Preferably the mounting plate is formed from a single sheet of metal.

Preferably the base plate at the ground is mounted to prevent side to side movement at the ground.

In another arrangement wherein the mounting plate is located with the edge flange portion attached to the roof deck where the mounting plate is located with the edge flange portion underneath the shingles.

Preferably the receiving hole is dimensioned relative to the post to allow the post to pass through the hole while at an angle to the plate different from 90 degrees to allow the plate to be placed at an angle defined by the roof deck.

Preferably the safety rails are attached to the post by scaffolding clamps.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figures 1, 2:
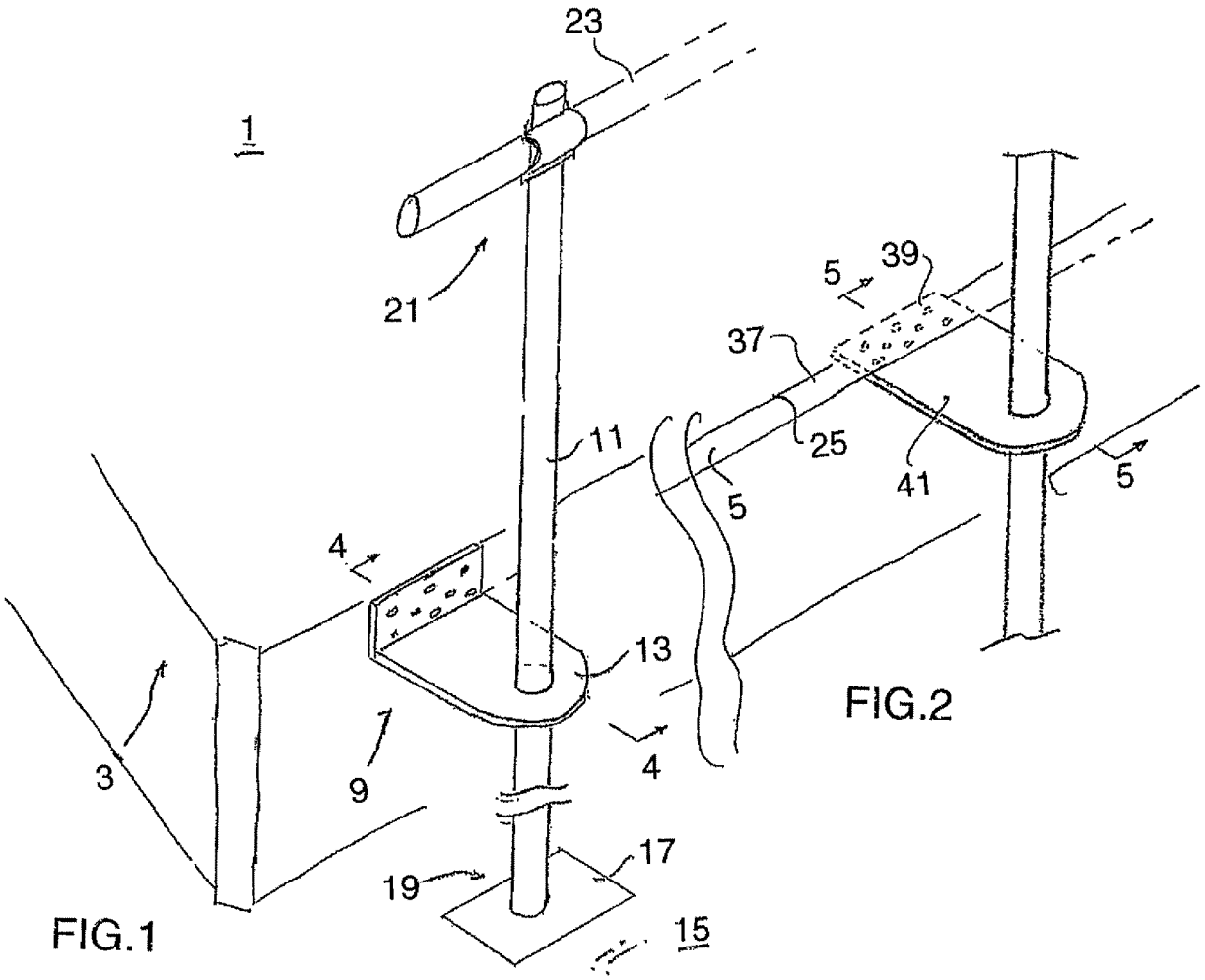
FIG. 1 is an isometric view of a first embodiment of the present invention.
FIG. 2 is an isometric view of a second embodiment of the present invention.

FIGS. 1 and 2 illustrate first and second embodiments of the present invention. Illustrated is a house 1, more specifically a partial roof 3 of the house. Generally, house roof construction has a face plate 5 which runs along the length of the house. The face plate is arranged to support the soffit and fascia of the house. When building a home, specifically working on the roof of a house, there are is a danger of a worker falling off the roof. The face plate is generally a 2×6 inch length of lumber whereby the face plate is mounted with the wide portion 7 is mounted vertically on the house roof. The face plate is suitable secured to the house.

As illustrated in FIG. 1, a safety rail mount for a roof 9 is mounted to the face plate of the roof system. Vertical posts 11 are supported by a mounting plate 13. The posts are arranged to extend downwardly to a suitable support surface 15 such as the ground or a base plate anchored to the ground. The post has a support plate 17 at a bottom end 19 which allows the post to be placed on the supporting surface. At a top end 21 of the post is a guide rail 23 arranged to prevent workers from falling off the building so as to avoid the necessity for a harness arrangement worn by the worker.

Figure 3:
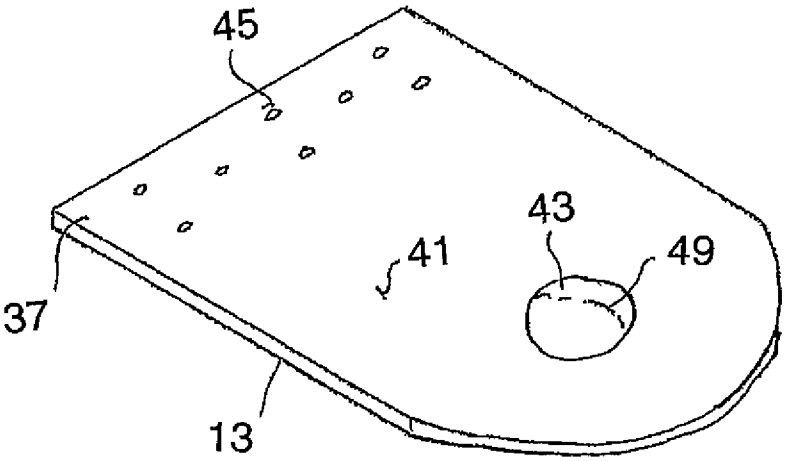
FIG. 3 is an isometric view of the mounting plate portion of the embodiment of FIG. 2 of the present invention.
Figure 4:
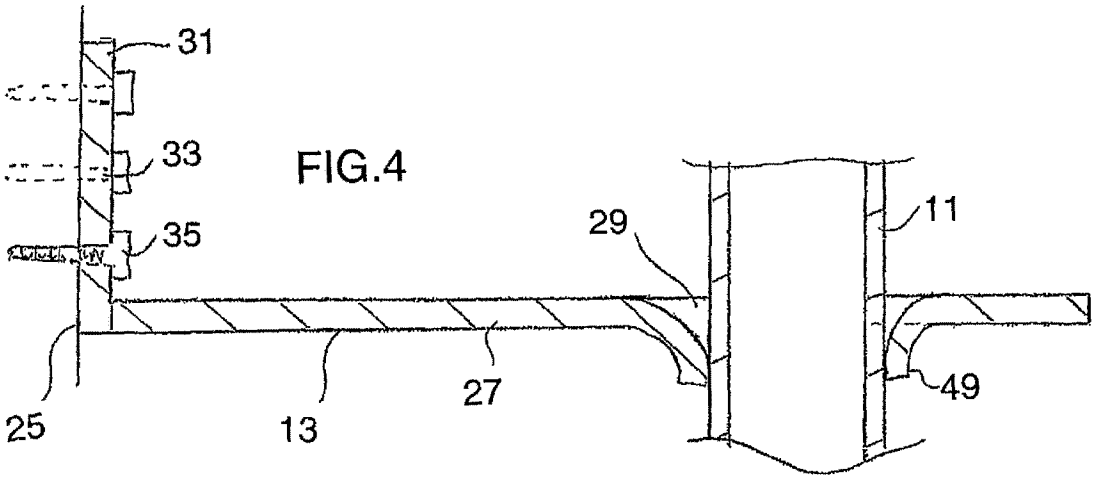
FIG. 4 is a cross sectional view along the lines 4-4 of FIG. 1.

The posts are supported vertically by the mounting plate. In a first embodiment of the mounting plate, as illustrated in FIGS. 3 and 4, the plate is arranged to mount to an outer face 25 of the face plate of the roof system. The plate has a horizontal section 27 which is arranged to extend horizontally from the outer face of the face plate. A receiving hole 29 is arranged to receive the vertical post and is positioned on the horizontal section such that the post is positioned sufficient distance from the edge of the roof allowing the post to extend downwardly to the ground and vertically for receiving the guard rails.

A vertical mount 31 of the mounting plate extends vertically from the horizontal plate such that the plate can be mounted to the outer face of the face plate. The vertical mount has holes 33 to receive mounting bolts 35 for sufficiently mounting the plate to the face plate. Some of the holes can be located at the junction between the angle parts so as to pass through the plate into the face plate at an angle of roughly 45 degrees to the plate.

Figure 3A:
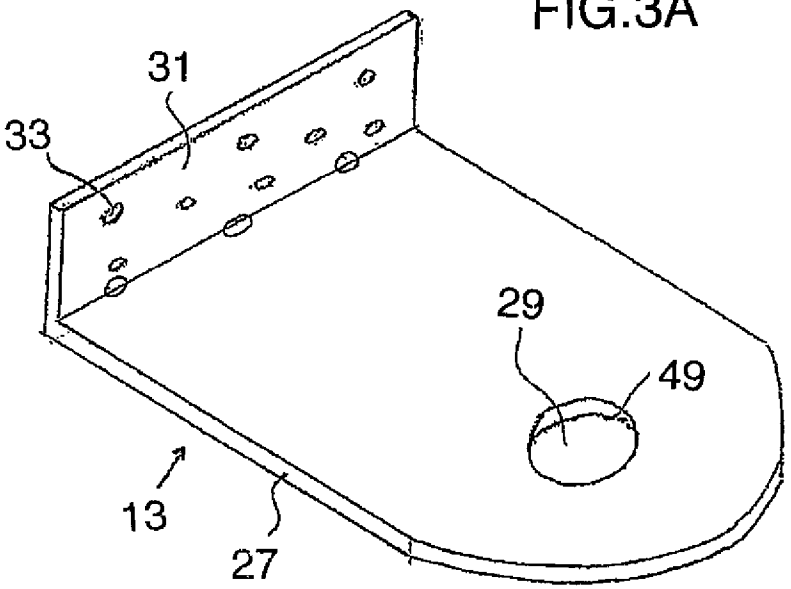
FIG. 3A is an isometric view of the mounting plate portion of the embodiment of FIG. 1 of the present invention.
Figure 5:
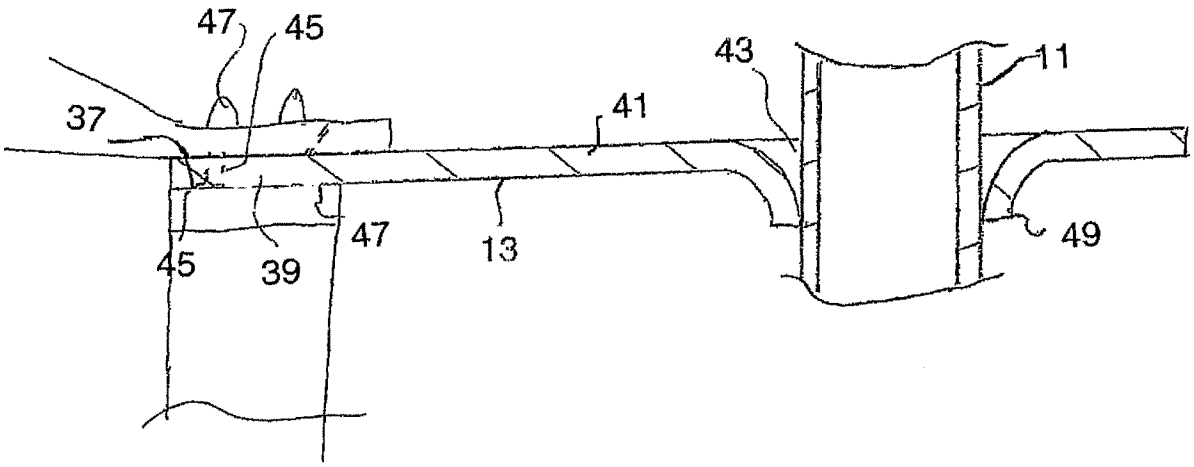
FIG. 5 is a cross sectional view along the lines 5-5 of FIG. 1.

In a second embodiment of the present invention, as illustrated in FIGS. 3A and 5 the mounting plate is arranged to mount to a top face 37 of the face plate or on top of the plywood fastened to the face plate and underneath the shingles if already applied. A horizontal mount portion 39 of the mounting plate extends from the horizontal plate of the mounting plate. The plate has a horizontal section 41 which is arranged to extend horizontally or at small angle downwardly and outwardly from the outer face of the face plate. A receiving hole 43 is arranged to receive the vertical post and is positioned on the section 41 such that the post is positioned sufficient distance from the edge of the roof allowing the post to extend downwardly to the ground outwardly of the eavestrough, if already in place, and vertically for receiving the guard rails.

The horizontal mount has holes 45 to receive mounting screw fasteners 47 for sufficiently mounting the plate to the top side of face plate.

The receiving hole 43 has a recessed portion 49 turned downwardly at the edge so that the vertical post can be inserted easily therethrough. The plate is arranged support the post in a vertical position preventing horizontal movement of the post. The hole is slightly larger than the post to allow the plate to lie at an angle to the post when attached to the roof deck due to the pitch of the roof. Alternatively the plate can be bent at an angle matching that of the deck so that the portion of the plate which contains the hole is located at right angles to the post.

Figure 6:
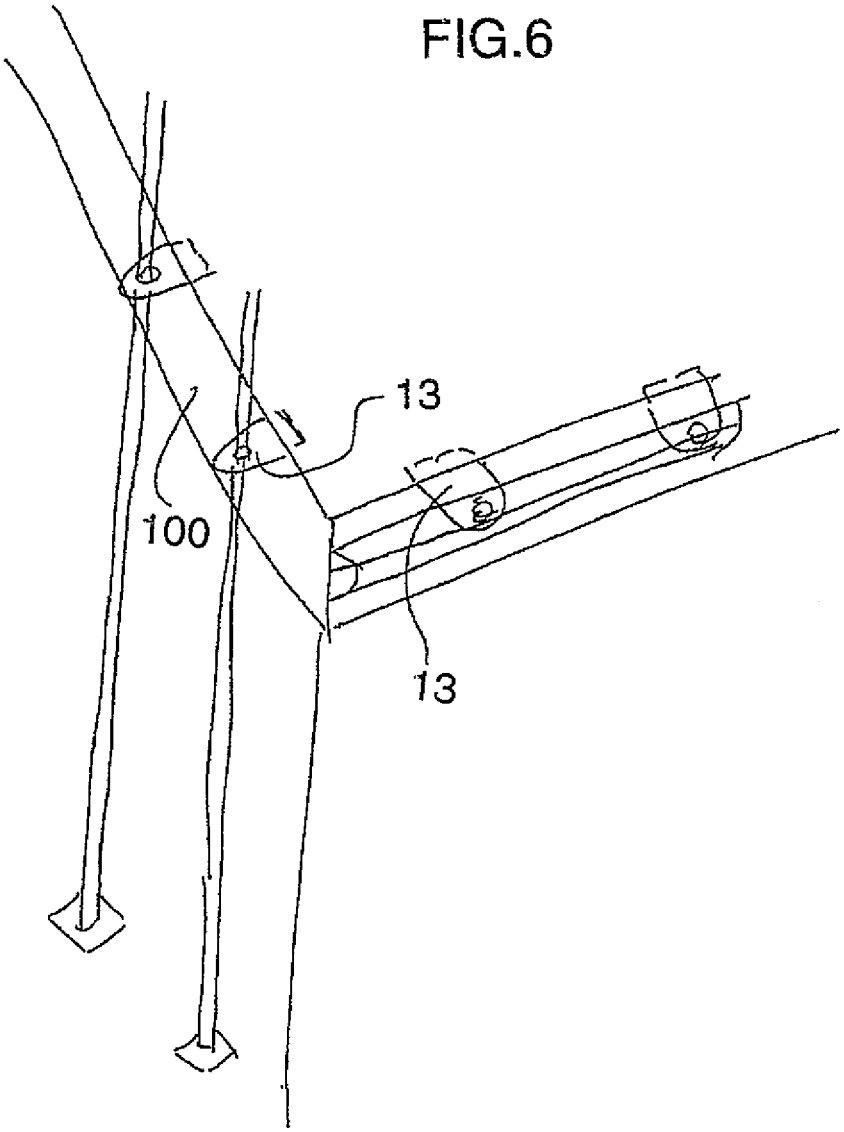
FIG. 6 is a schematic isometric view of the plate members of FIG. 3A mounted at the edge of a pitched roof of the present invention.

In FIG. 6 is shown the plates 13 of FIG. 3 located along the horizontal faceplate at one side of the building and along an end roof rafter 100. In both cases the edge portion 39 of the plate is tucked under the shingles and fastened by downwardly extending screws into the face plate and into the roof rafter. In both cases the plates are inclined from the horizontal due to the pitch of the roof. Each plate is associated with a respective vertical post extending to the base plate at the ground and two or more horizontal rails are applied to the portion of the post above the plate.

The mounting plate consists of an integral plate and is formed from a single sheet of metal with a portion for screw fastening to the face plate and a plate portion extending outwardly from the roof and containing the hole at a position spaced outwardly sufficiently to clear the eavestrough.

Where shingles are already applied, the mounting plate is located with its edge underneath the shingles.

The base plate is fastened to the ground by stakes or other fasteners to prevent side to side movement at the ground.

The receiving hole is dimensioned relative to the post to allow the post to pass through the holes while at an angle to the plate different from 90 degrees to allow the plate to be placed at an angle defined by the roof pitch.

The safety rails can be attached to the post by scaffolding clamps or similar tubular clamps which hold the rails at a fixed/height on the post.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A building comprising:

a root at a raised height above around surrounding the building;

the roof having a vertical face plate extending along the length of the roof; and an apparatus for mounting a safety railing to the roof, the apparatus comprising:

a mounting plate member consisting of a single sheet of metal having a flat, substantially planar mounting plate portion with an edge flange portion bent at a right angle to the flat mounting plate portion;

the flange portion mounted by screw fasteners to the vertical face plate of the roof with the flat mounting plate portion extending outwardly from the vertical face plate at a right angle thereto;

a receiving hole through the mounting plate portion;

a vertical support post separate from the mounting plate member and extending through the hole to form an upper portion of the post above the mounting plate portion and a lower portion of the post extending downwardly from the mounting plate portion to a bottom end of the post at the ground;

a horizontal safety rail arrangement supported by the upper a portion of the vertical post above the mounting plate member; and a support on the ground below the mounting plate member engaging and supporting the bottom end of the post so as to extend from the support at the ground through the hole in the mounting plate to the safety rail arrangement with the support maintaining the post in a vertical position and the mounting plate member preventing horizontal movement of the post.

2. A building comprising:

a roof at a raised height above ground surrounding the building;

the roof having a vertical face plate extending along the length of the roof; and an apparatus for mounting a safety railing to the roof, the apparatus comprising:

a mounting plate member consisting of a single sheet of metal defining a flat, substantially planter mounting plate portion;

one edge portion of the flat mounting plate portion being mounted by screw fasteners passing through holes in the edge portion to a horizontal top edge of the vertical face plate of the roof with the flat mounting plate portion extending outwardly from the vertical face plate at a right angle thereto;

a receiving hole through the mounting plate portion; a vertical support post separate from the mounting plate member and extending through the hole to form an upper portion of the post above the mounting plate portion and a lower portion of the post extending downwardly from the mounting plate portion to a bottom end of the post at the ground;

a horizontal safety rail arrangement supported by the upper portion of the vertical post above the mounting plate member; and a support on the ground below the mounting plate member engaging and supporting the bottom end of the post so as to extend from the support at the ground through the hole in the mounting plate to the safety rail arrangement with the support maintaining the post in a vertical position and the mounting plate member preventing horizontal movement of the post.

3. A building comprising:

a roof at a raised height above ground surrounding the building;

the roof having a vertical face plate extending along the length of the roof and an inclined roof deck; and an apparatus for mounting a safety railing to the root, the apparatus comprising:

a mounting plate member consisting of a single sheet of metal defining a flat, substantially planer mounting plate portion;

one edge portion of the flat mounting plate portion being mounted by screw fasteners passing through holes therein to the inclined root deck with the flat mounting plate portion extending outwardly from the inclined roof deck at an angle to the vertical face plate different from 90 degrees and defined by the inclined roof deck;

a receiving hole through the mounting plate portion;

a vertical support post separate from the mounting plate member and extending through the hole to form an upper portion of the post above the mounting plate portion and a lower portion of the post extending downwardly from the mounting plate portion to a bottom end of the post at the ground;

a horizontal safety rail arrangement supported by the upper portion of the vertical post above the mounting plate member; and a support on the ground below the mounting plate member engaging and supporting the bottom end of the post so as to extend from the support at the ground through the hole in the mounting plate to the safety rail arrangement with the support maintaining the post in a vertical position and the mounting plate member preventing horizontal movement of the post;

wherein the receiving hole is dimensioned relative to the post to allow the post to pass through the hole while the post is at said angle to the plate.

* * * * *